US007163277B2

(12) United States Patent
Ueda et al.

(10) Patent No.: US 7,163,277 B2
(45) Date of Patent: Jan. 16, 2007

(54) IMAGE FORMING APPARATUS AND IMAGE SCANNER

(75) Inventors: Kiyoshi Ueda, Aichi (JP); Yukio Shiohara, Aichi (JP); Hiroaki Yazawa, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 229 days.

(21) Appl. No.: 10/831,287

(22) Filed: Apr. 26, 2004

(65) Prior Publication Data

US 2004/0263568 A1 Dec. 30, 2004

(30) Foreign Application Priority Data

Apr. 25, 2003 (JP) ..... P2003-121584

(51) Int. Cl.
*B41J 2/14* (2006.01)
*B41J 23/00* (2006.01)

(52) U.S. Cl. ..... 347/47; 347/37

(58) Field of Classification Search ..... 347/47
See application file for complete search history.

(56) References Cited

U.S. PATENT DOCUMENTS 5,486,849 A 1/1996 Miura et al.
6,270,184 B1 8/2001 Igarashi et al.
2002/0109752 A1* 8/2002 Sato ..... 347/43
2003/0063170 A1* 4/2003 Umeyama et al. ..... 347/93
2003/0081061 A1* 5/2003 Gunther et al. ..... 347/43

FOREIGN PATENT DOCUMENTS

| | | |
|---|---|---|
| JP | A 03-290256 | 12/1991 |
| JP | A 08-258369 | 10/1996 |
| JP | A 10-109458 | 4/1998 |
| JP | A 2002-67279 | 3/2002 |
| JP | A 2002-205439 | 7/2002 |
| JP | A 2003-53947 | 2/2003 |

* cited by examiner

*Primary Examiner*—Vip Patel
*Assistant Examiner*—Jannelle M. Lebron
(74) *Attorney, Agent, or Firm*—Oliff & Berridge, PLC

(57) ABSTRACT

An image forming apparatus includes: a recording head unit having a first retained portion and one or more nozzle arrays in a nozzle surface thereof, each of the nozzle arrays being formed of a plurality of nozzles for ejecting ink onto a recording medium; and a retaining member that retains the recording head unit. The retaining member includes: a first retention portion that retains the first retained portion of the recording head unit to allow the nozzle surface rotate within a plane thereof by using the first retained portion; an inclination adjusting mechanism that moves the recording head unit with respect to the retaining member with the first retained portion being used as the center of rotation; and an urging member that presses and urges the recording head unit against the inclination adjusting mechanism and moves in cooperation with the inclination adjusting mechanism.

21 Claims, 13 Drawing Sheets

IMAGE FORMING APPARATUS AND IMAGE SCANNER

BACKGROUND OF THE INVENTION

1. Field of the Invention

The present invention relates to an image forming apparatus and an image scanner such as a printer, a facsimile machine or a copying machine, and particularly relates to a structure of image forming apparatus in which a recording head unit including nozzle arrays each having a plurality of nozzles for ejecting ink onto a recording medium is attached to a carriage.

2. Description of the Related Art

Some image forming apparatus in the background art such as printing machines, facsimile machines and copying machines are of an inkjet system in which ink droplets are ejected from nozzles of an inkjet head so as to form an image on paper as a recording medium. For example, of such apparatus, some are of a type in which are cording head unit having one or more nozzle arrays each comprised of a plurality of nozzles is attached to a carriage provided movably forward and backward in a direction crossing a conveyance direction of a recoding medium so that the nozzle arrays extend long in the conveyance direction, but some are of a type in which a recording head unit having one or more nozzle arrays each comprised of a plurality of nozzles is attached to a fixed carriage so that the nozzle arrays extend in a direction crossing a conveyance direction of a recoding medium. In either type, the printing quality is greatly affected when the array direction of the nozzle arrays in the recording head unit is correctly aligned with the conveyance direction of the recording medium. It is therefore extremely important to align the recording head unit correctly with the carriage to which the recording head is attached.

As such a technique for aligning a recording head unit with a carriage, a document JP-A-2003-053947 discloses an inclination adjusting mechanism for adjusting the left/right inclination of the recording head unit. According to the document, an eccentric rotor (cam) is attached to the lower portion of the right side surface of the carriage, while an abutment portion (pad block) is provided in the lower portion of the right side surface of the recording head unit so as to project outward. The abutment portion is disposed so that the eccentric rotor abuts against the back surface of the abutment portion. The recording head unit is thus received in the carriage. In this configuration, the abutment portion is moved by the rotation of the eccentric rotor so that the recording head unit is rotated and moved relatively to the carriage. Thus, the array direction of the nozzle arrays in the recording head unit is adjusted to be in position with respect to the carriage, and hence the inclination with respect to the conveyance direction of the recording medium (or a direction crossing the conveyance direction) is eliminated.

On the other hand, in the configuration according to the document JP-A-2003-053947, pressed portions are made to project outward from the upper portions of the left and right side surfaces of the recording head unit respectively. The pressed portions are locked in recess portions of the left and right side surfaces of the carriage respectively. The pressed portions are pressed obliquely downward by wire springs attached to the left and right side surfaces of the carriage respectively. Thus, a force to press the recording head unit onto the back surface and the bottom surface of the carriage simultaneously is generated so that the recording head unit removably attached to the carriage is prevented from rattling or being out of position.

SUMMARY OF THE INVENTION

Due to the aforementioned wire springs in the document JP-A-2003-053947, the force acts on the recording head unit so as to urge the recording head unit as a whole toward the back surface of the carriage. However, the pressed portions provided in the upper portions of the side surfaces of the recording head unit are pressed directly by the wire springs, but the pressure to the back surface is not applied directly to the abutment portion located in the lower portion far from the pressed portions. Accordingly, when the position of the recording head unit relative to the carriage is adjusted by the inclination adjusting mechanism, the abutment portion may be moved too much from the back surface side to the front surface side by the eccentric rotor, or after the adjustment is once completed, the abutment portion may be displaced away from the eccentric rotor toward the front surface due to impact or the like on the apparatus. In such a case, there is a fear that the abutment portion does not follow the operation of rotating the eccentric rotor to thereby restore the abutment portion to the back surface side. In such a case a user has to adjust the recording head unit manually.

The present invention was developed to solve problems as such described above. One of objects of the invention is to provide an image forming apparatus having an inclination adjusting mechanism for aligning nozzle arrays of a recording head unit correctly with the conveyance direction of a recording medium, while adjustment using the inclination adjusting mechanism can be achieved finely and accurately in any direction of the adjustment.

In order to achieve the above object, according to a first aspect of the invention, there is provided an image forming apparatus including: a recording head unit having a first retained portion and one or more nozzle arrays in a nozzle surface thereof, each of the nozzle arrays being formed of a plurality of nozzles for ejecting ink onto a recording medium; and a retaining member that retains the recording head unit and comprises: a first retention portion that retains the first retained portion of the recording head unit to allow the nozzle surface rotate within a plane thereof by using the first retained portion as a center of rotation; an inclination adjusting mechanism that moves the recording head unit with respect to the retaining member with the first retained portion being used as the center of rotation; and an urging member that presses and urges the recording head unit against the inclination adjusting mechanism and moves in cooperation with the inclination adjusting mechanism.

According to a second aspect of the invention, there is provided an image scanner including: a scanning head unit having a first retained portion and a scanning surface that scans an image formed on a medium to be scanned; and a retaining member that retains the scanning head unit and comprises: a first retention portion that retains the first retained portion of the scanning head unit to allow the scanning surface rotate within a plane thereof by using the first retained portion as a center of rotation; an inclination adjusting mechanism that moves the scanning head unit with respect to the retaining member with the first retained portion being used as the center of rotation; and an urging member that presses and urges the scanning head unit against the inclination adjusting mechanism and moves in cooperation with the inclination adjusting mechanism.

BRIEF DESCRIPTION OF THE DRAWINGS

A preferred embodiment of the present invention will be described in detail with reference to the following accompanying drawings, in which.

DETAILED DESCRIPTION OF THE PREFERRED EMBODIMENTS

Referring now to the accompanying drawings, a description will be given in detail of preferred embodiments of the invention.

Figure 1:
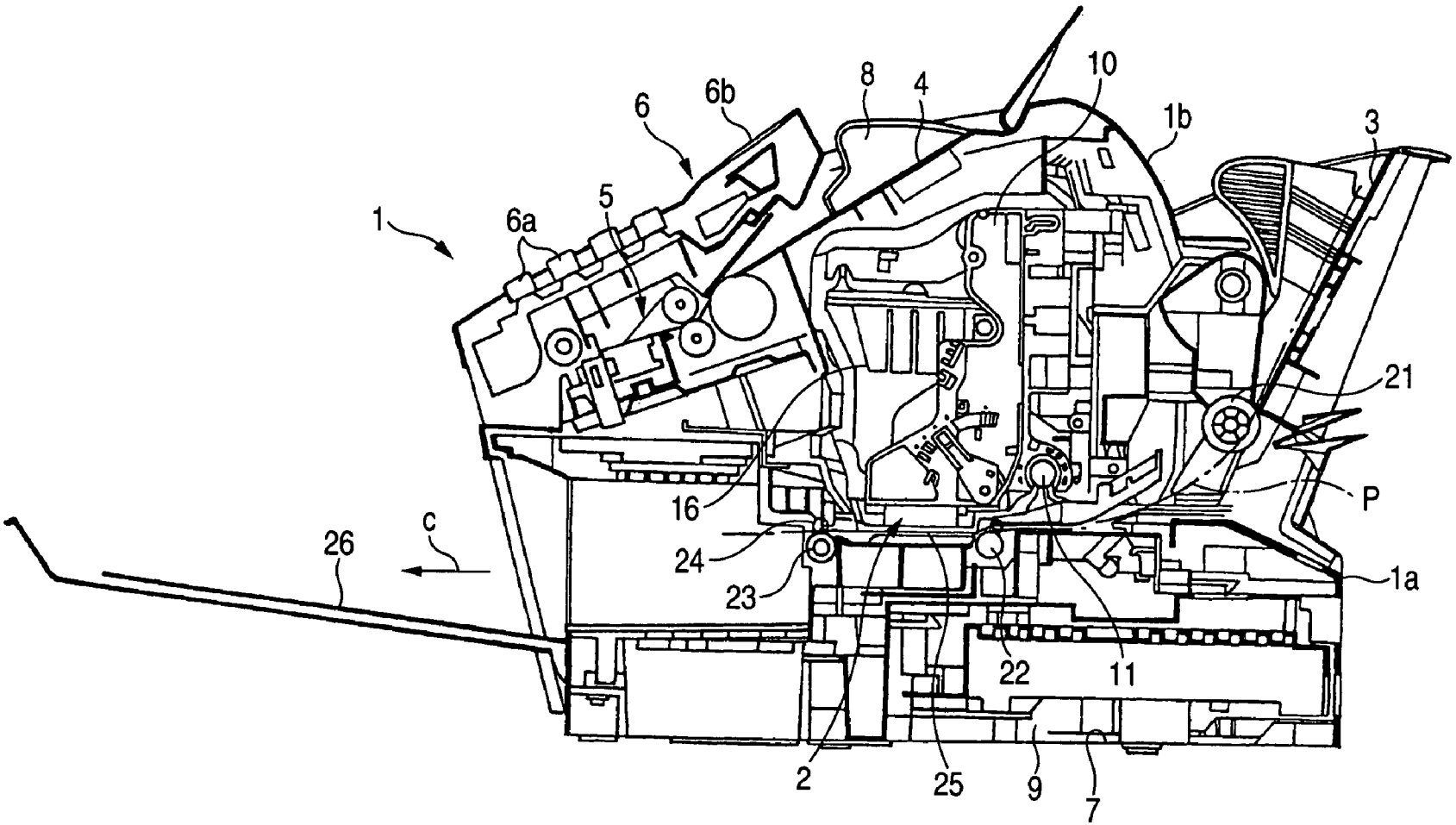
FIG. 1 is a schematic right side sectional view of multifunctional apparatus having functions such as a facsimile function, a scanner function, a printer function, and a copying machine function., as an example of image forming apparatus to which the invention is applied.
Figure 2A:
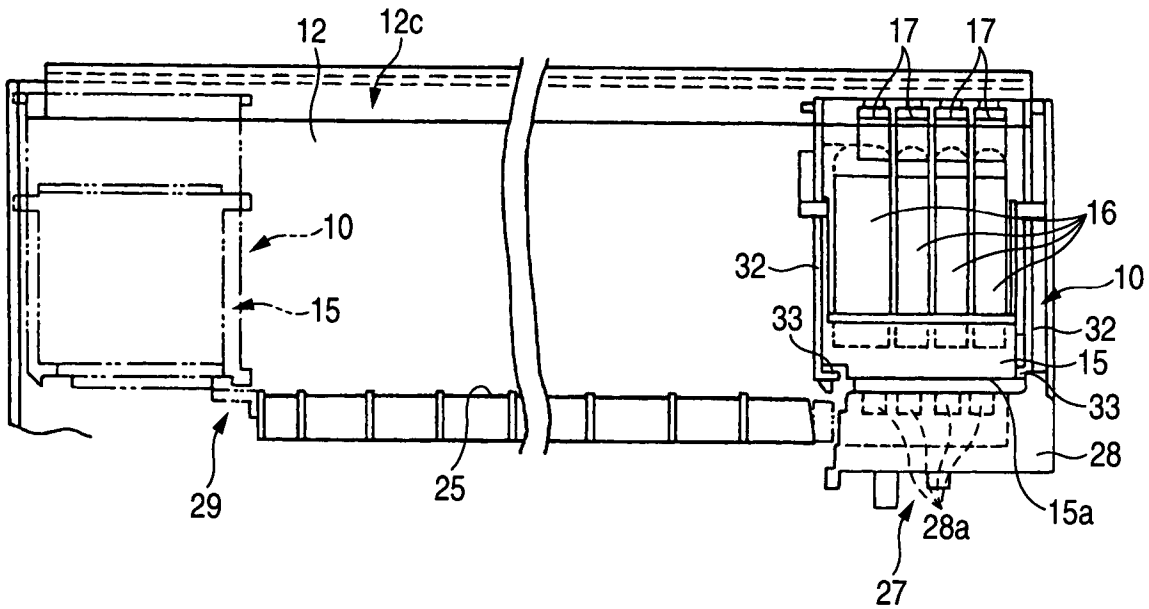
FIG. 2A is a front view of a recording portion.
Figure 2B:
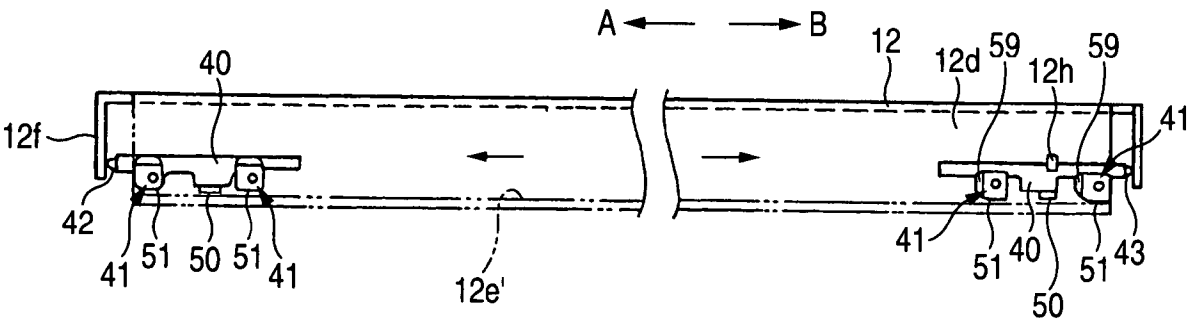
FIG. 2B is a cross-sectional view of the recording portion.

A body casing of multifunctional apparatus 1 includes a main lower casing 1*a* made of synthetic resin and an upper casing 1*b* made of synthetic resin as shown in FIGS. 1, 2A and 2B. The main lower casing 1*a* receives an inkjet recording portion 2 and includes a paper feed tray 3 for feeding sheet P as a recording medium for forming an image thereon. The paper feed tray 3 is provided at the rear of the main lower casing 1*a* so as to be inclined upward. The upper casing 1*b* covers the upper side of the main lower casing 1*a*.

A sheet mounting portion 4 is disposed in a portion close to the rear top of the upper casing 1*b*, and a sheet scanning unit 5 as a sheet reading portion is attached to a portion close to the front of the sheet mounting portion 4. The upper side of the sheet scanning unit 5 is covered with an operation panel portion 6. An operation key portion 6*a* including various function keys and a ten key pad, and a display portion 6*b* such as a liquid crystal panel capable of displaying values inputted from the operation key portion 6*a* or various characters or digits for operation are provided in the surface of the operation panel portion 6. A pair of left and right sheet guide plates 8 sliding to left and right in accordance with the width of a sheet to be conveyed are attached to the sheet mounting portion 4 so as to guide the opposite, left and right side edges of the sheet.

Incidentally, the lower surface of the main lower casing 1*a* is closed with a bottom cover plate 7 made of a material such as a metal plate. A control portion 9 is disposed in an internal space of the main lower casing 1*a*. Though not shown, the control portion 9 includes a control board, a power supply board, an NCU (Network Control Unit) board for opening the way for conversation with other telephone sets or transmission/reception of facsimile data with other facsimile machines through a phone line, and so on. Further, though not shown, a handset for conversation with another telephone set is mounted on a cradle provided to project outward from a side portion of the main lower casing 1*a*. In addition, a speaker for calling and monitoring is fixed to the rear side of the right side surface or the like in the main lower casing 1*a*.

Figure 5:
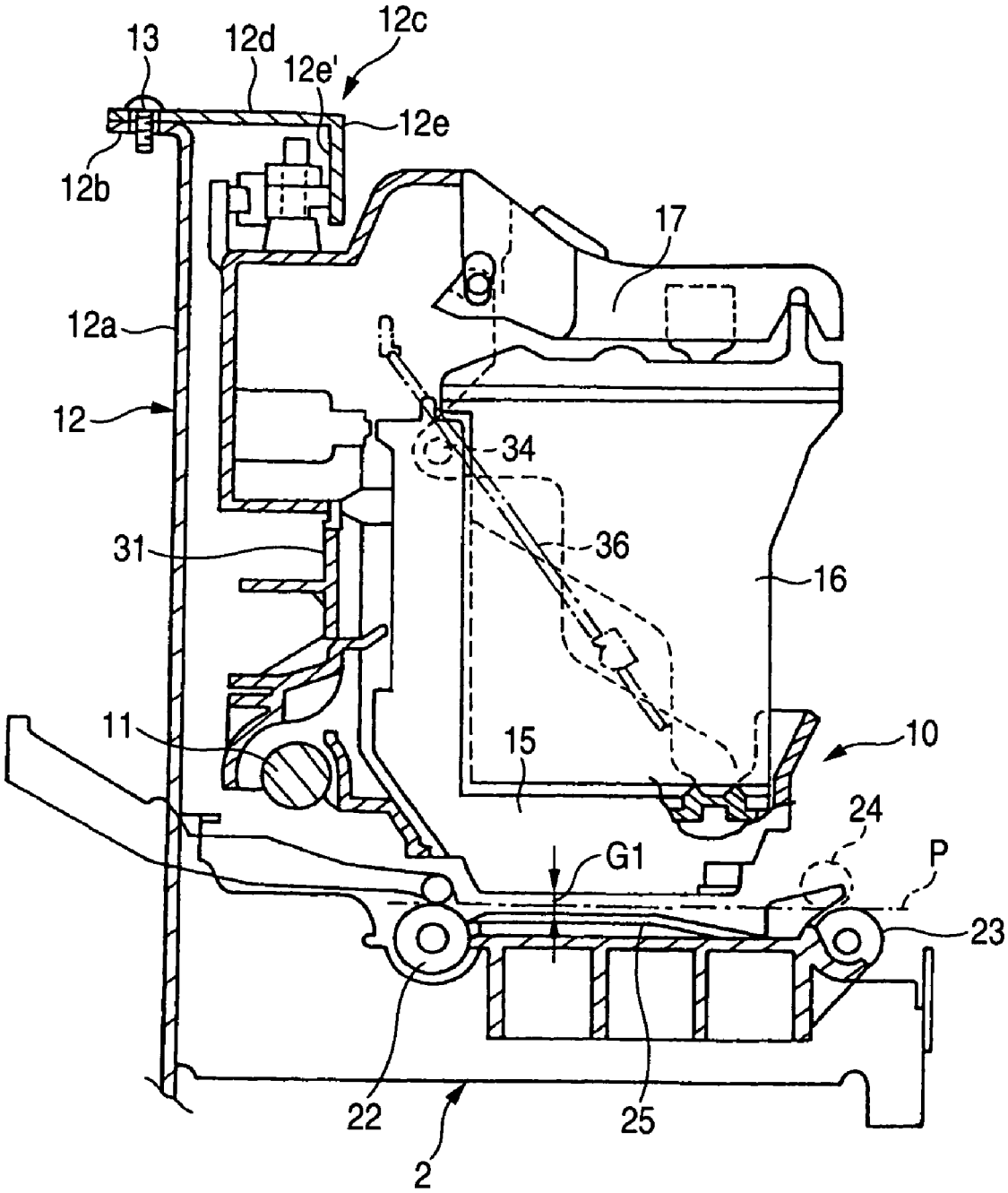
FIG. 5 is a left side sectional view of the carriage mounted with a frame and a recording head unit.

As shown in FIGS. 1 and 5, the rear end of the lower portion of a carriage 10 in the recording portion 2 is attached to a guide shaft 11 like a round shaft so that the carriage 10 can slide and rotate thereon. The guide shaft 11 is attached to the surface (front) side of the lower portion of an upright frame 12 which is longer horizontally.

In addition, a timing belt (not shown) extending in parallel with the guide shaft 11 is wound on a driven pulley (not shown) and a driving pulley (not shown). The driven pulley is disposed closely to one side of the frame 12, and the driving pulley is fixed to the output shaft of a drive motor (not shown) such as a stepping motor which can rotate forward and backward. The timing belt is coupled at one place with the carriage 10 so that the carriage 10 can move forward and backward in parallel with the guide shaft 11. Incidentally, as shown in FIG. 1, sheets of the sheet P stacked on the paper feed tray 3 are separated one by one by a paper feed roller 21 and a separation unit. The paper feed roller 21 serves as a paper feed mechanism with a structure known well conventionally and is disposed in the rear portion of the main lower casing 1*a*. The separation unit is constituted by a separation pad, a frictional separation plate or the like. The forward end position of the separated sheet P is once adjusted by a registration roller 22 for adjusting the timing of the forward end of the sheet P. After that, the sheet P is fed between the bottom of the recording head unit 15 and a platen 25. While the sheet P is held and conveyed between a pair of upper and lower conveyance rollers 23 and 24 on the downstream side of conveyance, ink droplets are ejected onto the upper surface of the sheet P in accordance with a print instruction so as to record an image thereon. After that, the sheet P is ejected to a paper delivery tray 26.

Next, description will be made on the printing operation by the carriage 10 with reference to FIG. 2A. A maintenance portion 27 is provided out of the recording area and near the moving end of the carriage 10, for example, on the right side of the platen 25. A nozzle wiping unit (wiper unit) for wiping ink droplets adhering to the surfaces (face surfaces) of nozzle portions 15*a* of the recording head unit 15, and a purging unit (nozzle suction unit) 28 for recovering the recording head unit 15 from non-ejection of ink or failure in ejection of ink are disposed in the maintenance portion 27. In the purging unit 28, the nozzle portions of the recording head unit 15 are covered with suction caps 28*a*, and defective ink in the recording head unit 15 is sucked due to negative pressure generated by a not-shown pump so that the recording head unit 15 is recovered from failure in recording. The purging unit 28 in the maintenance portion 27 is located in a home position (right end position in FIG. 2A) of the moving end portion of the carriage 10. The purging unit 28 also serves as a capping mechanism (protective device) for covering all the nozzle portions 15*a* of the recording head unit 15 of the carriage 10 so as to prevent ink from being evaporated, and each suction cap 28*a* also has a function of a protective cap. In the following description, the reference numeral 28 designating the purging unit will be also used as the reference numeral designating the home position. In addition, a flushing portion 29 for ejecting ink from each nozzle portion 15*a* of the recording head unit 15 tentatively so as to prevent ink clogging is provided in the left end of the platen 25.

Next, description will be made on the configuration of the recording portion 2. The color inkjet cartridge type recording head unit 15 shown in FIGS. 2A, 2B and 3 through 5 is removably attached to the carriage 10 so as to face downward. The recording head unit 15 for performing color recording includes nozzle portions 15*a* on its bottom side. The nozzle portions 15*a* are provided for ejecting inks of colors of cyan, yellow, magenta and black respectively. Ink cartridges 16 for the respective colors can be removably mounted on the top side of the recording head unit 15 as shown in FIG. 2A. Ink to be supplied to the recording head unit 15 has been received in each ink cartridge 16. The ink cartridges 16 can be pressed downward and fixed respectively by pressure levers 17 (four in this embodiment) which can rotate up/down facing forward on the upper end side of the carriage 10.

Figure 6:
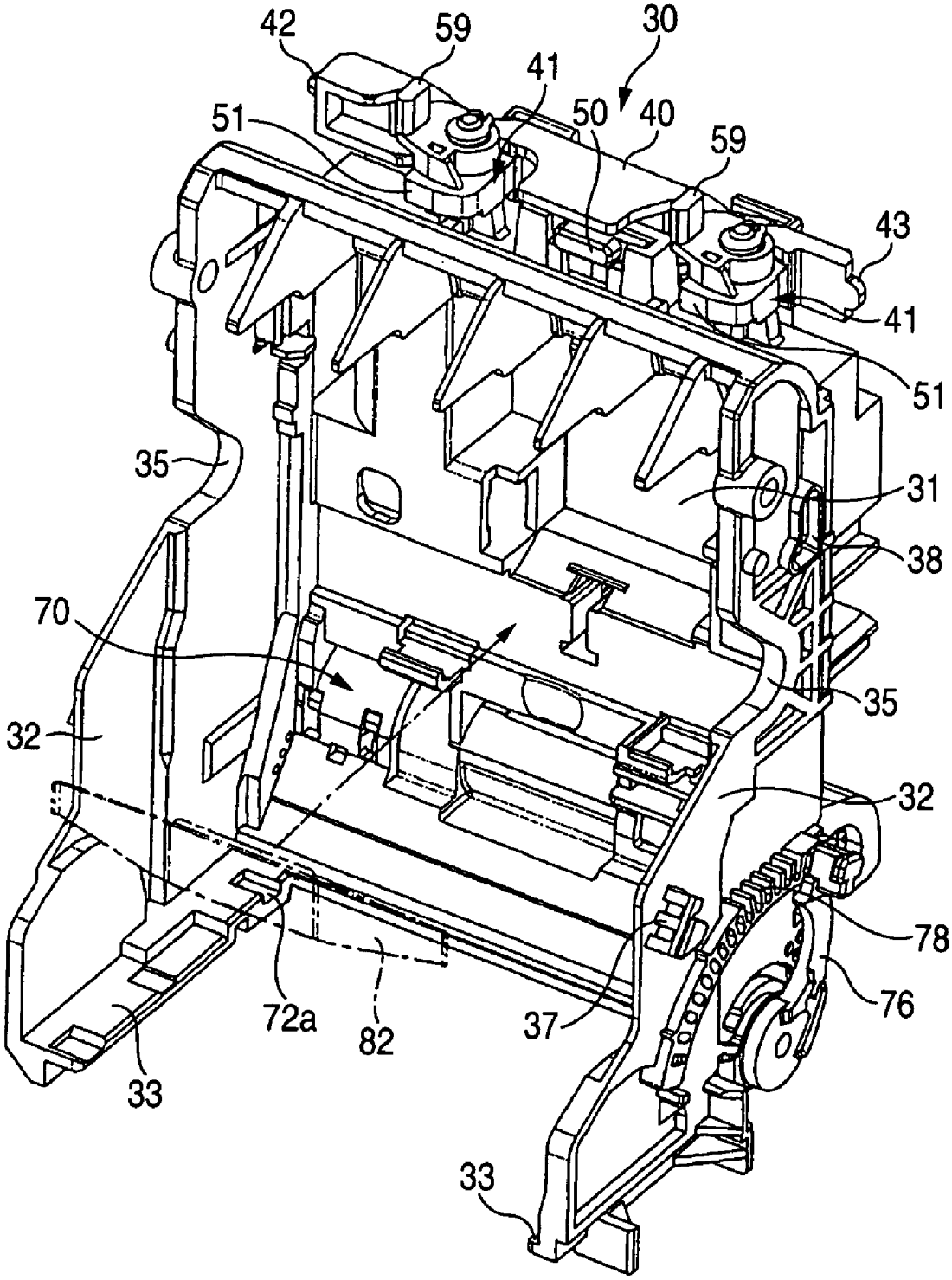
FIG. 6 is a front perspective view of the carriage.

The carriage 10 is an injection-molded piece made of synthetic resin containing glass short fibers. As shown in FIG. 6, opposite, left and right side plates 32 project forward from the opposite, left and right sides of a back plate 31 while bottom support portions 33 and 33 for supporting the opposite, left and right sides of the bottom plate of the recording head unit 15 are provided to project inward from the lower end portions of the side plates 32, respectively. A head receiving portion 70 for exposing the nozzle portions 15*a* of the recording head unit 15 downward between the opposite bottom support portions 33 and supporting the recording head unit 15 rotatably is provided in the carriage 10.

Figure 3:
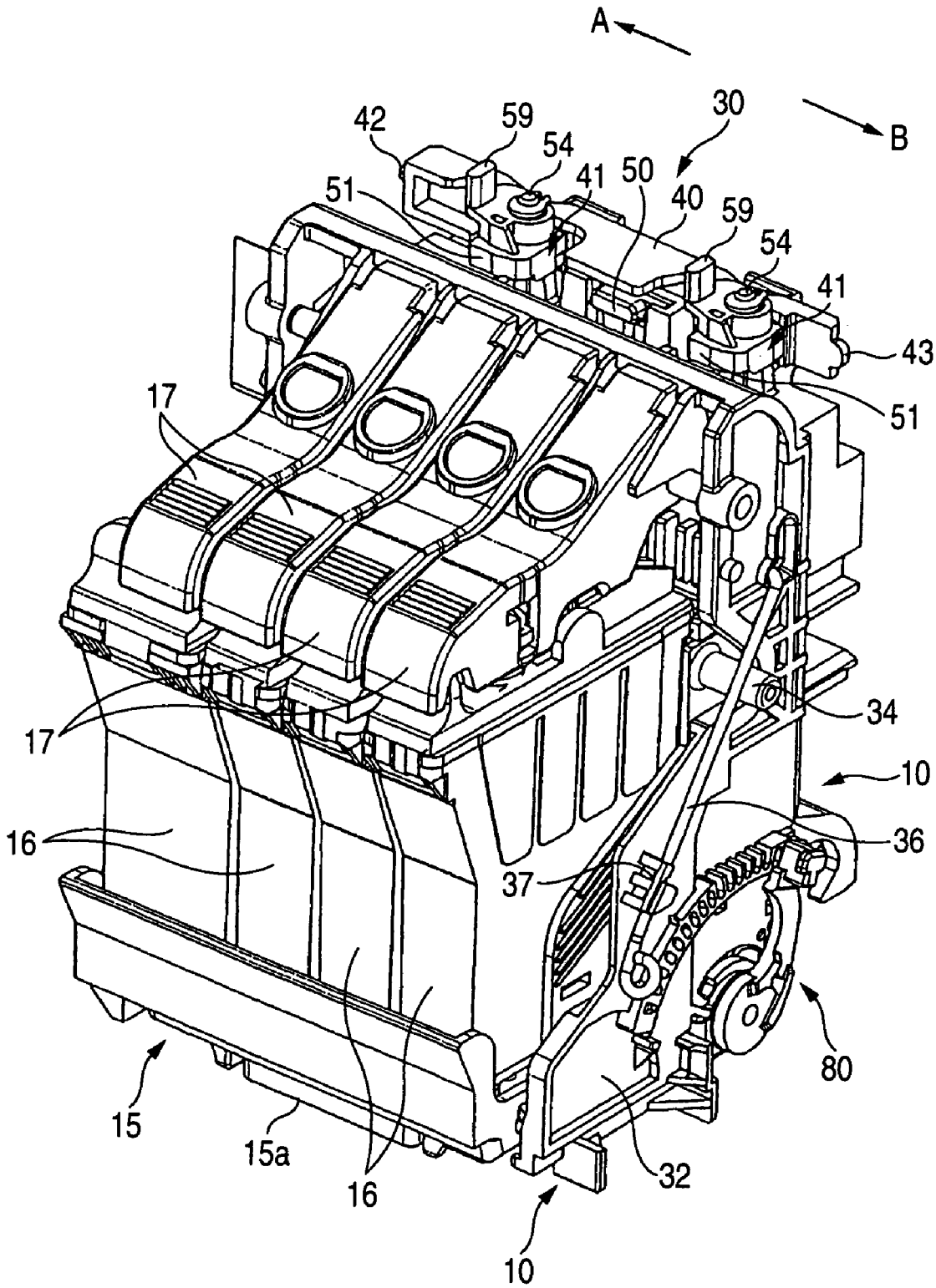
FIG. 3 is a front perspective view of a carriage.
Figure 4:
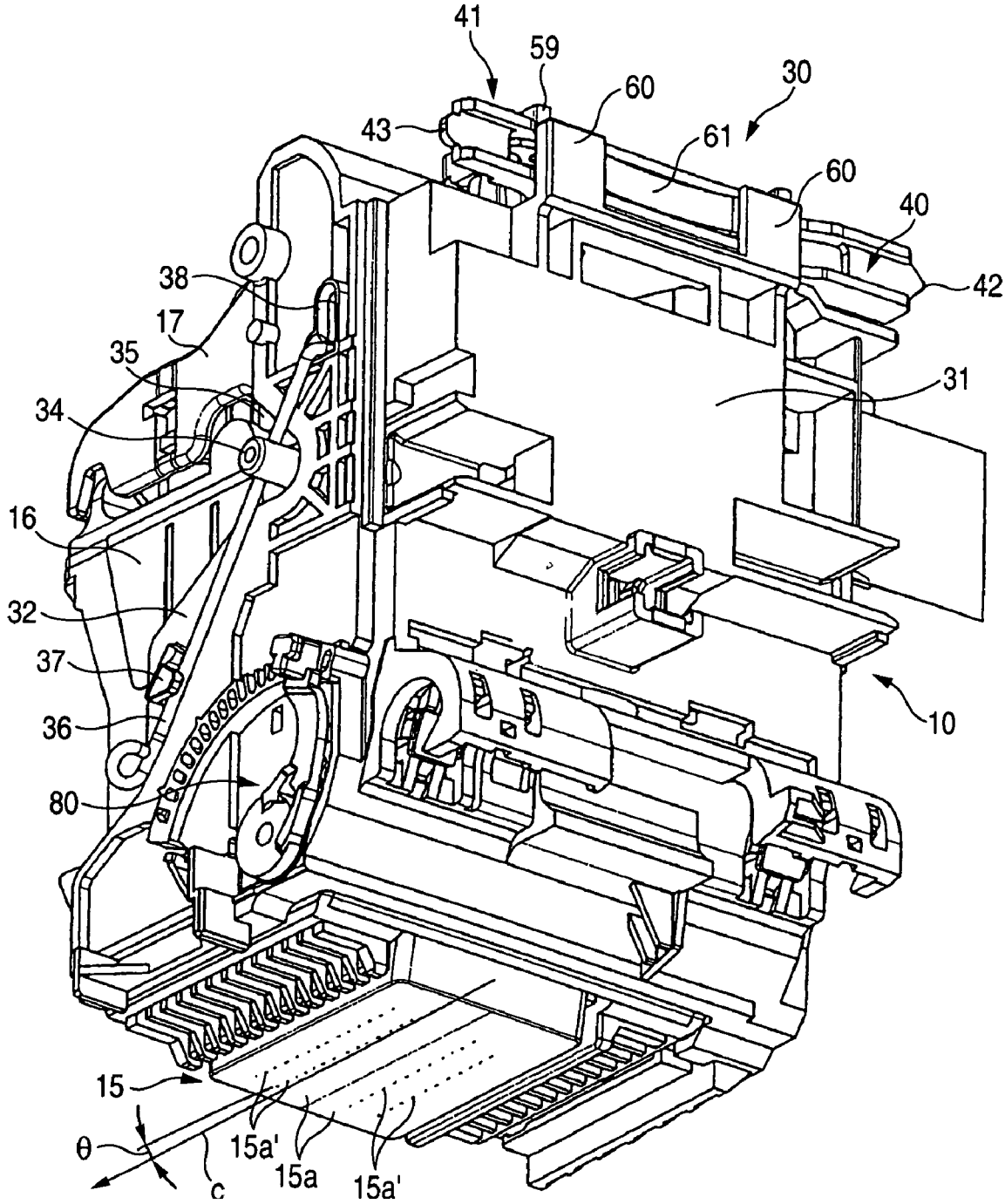
FIG. 4 is a back perspective view of the carriage.

Then, engagement pins 34 (see FIG. 7) projecting outward from the opposite, left and right sides of the recording head unit 15 are disposed in recesses 35 (see FIG. 6) formed as depressions in the opposite, left and right side plates 32 of the carriage 11, respectively (see FIGS. 3 and 4). In addition, the engagement pins 34 are pressed downward obliquely in the longitudinally middle portions of wire springs 36 having elasticity, respectively. The wire springs 36 are made of metal or the like, and rotatably attached to mounting holes 38 on the outside upper ends of the opposite, left and right side plates 32, respectively. On the other hand, the lower ends (free ends) of the wire springs 36 are locked in obliquely downward hook-like lock portions 37 so as to be prevented from moving upward and from falling out of the side plates 32 accidentally. The lock portions 37 are formed to project from the outside of the side plates 32, respectively. Thus, the recording head unit 15 is attached to the carriage 10 firmly and without rattling (see FIGS. 3 and 4). Due to the lock of the wire springs 36, the recording head unit 15 as a whole is pressed to the backside and the bottom side simultaneously.

Figure 12:
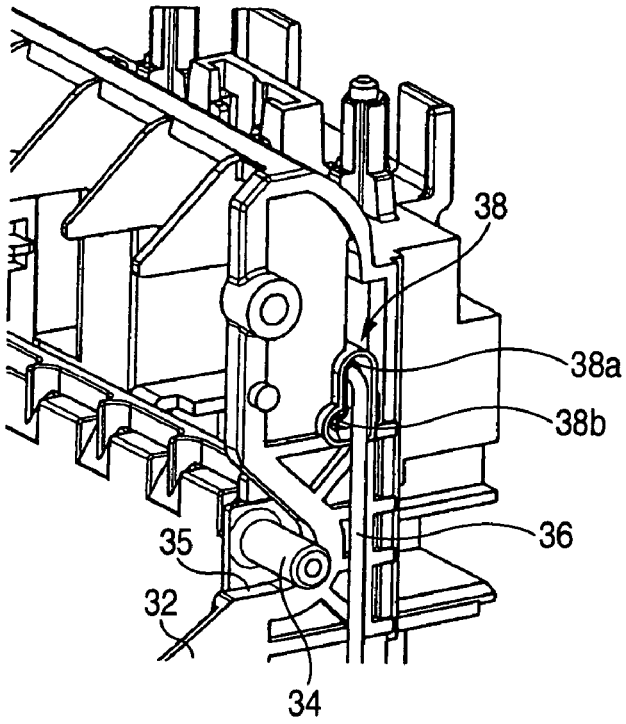
FIG. 12 is an explanatory view showing the attachment of a wire spring.
Figure 13:
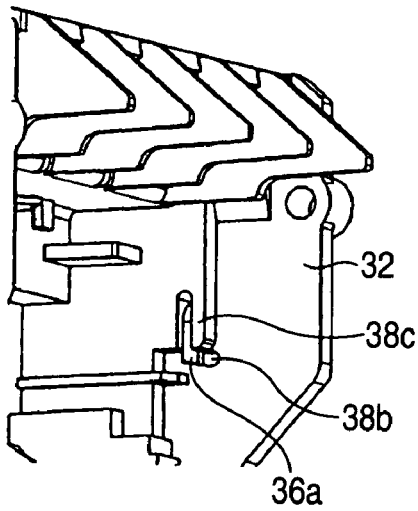
FIG. 13 is an explanatory view showing the attachment of the wire spring.
Figure 14:
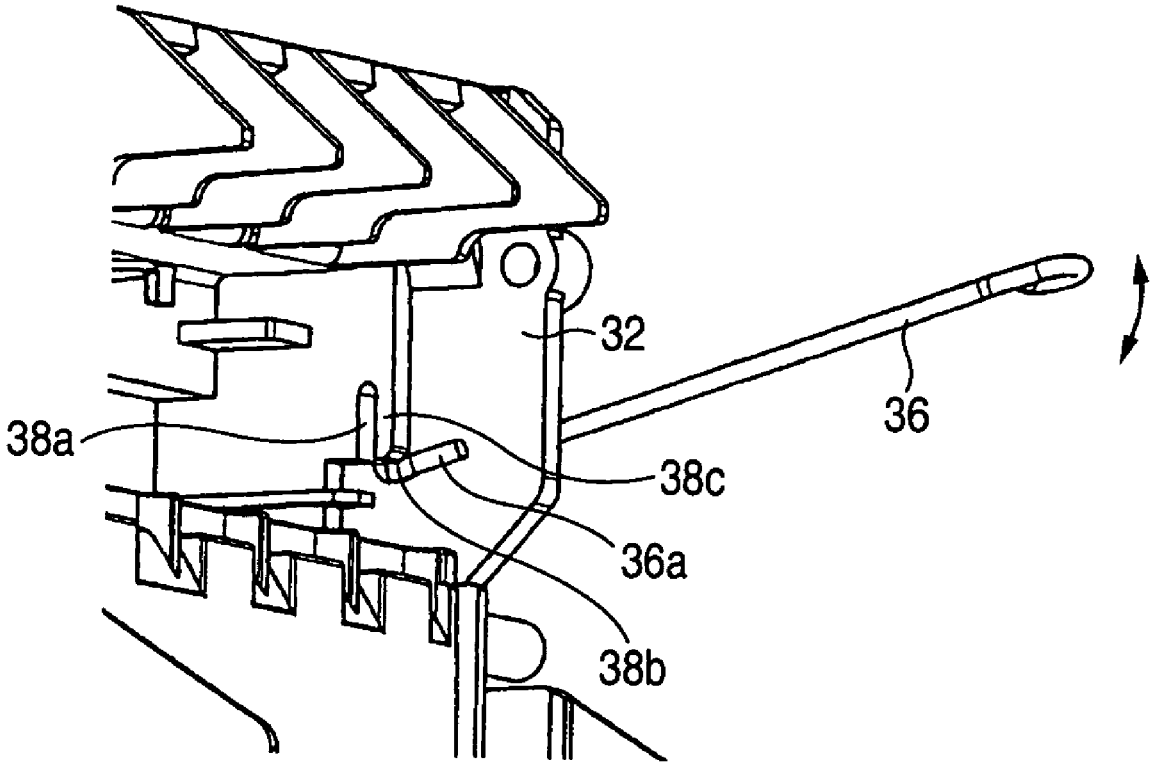
FIG. 14 is an explanatory view showing the attachment of the wire spring.

Incidentally, each mounting hole 38 is constituted by a first hole portion 38*a* extending vertically and a second hole portion 38*b* extending forward (horizontally) and continuously from the lower end of the first hole portion 38*a* as shown in FIG. 12. As shown in FIG. 13, a rib 38*c* extending vertically along the first hole portion 38*a* is provided substantially on the inner side of the first hole portion 38*a*. On the other hand, the upper end side of the wire spring 36 is bent into a U-lettered shape toward the inner side of the mounting hole 38, so as to form a bent portion 36*a* capable of engaging with the mounting hole 38. Accordingly, when the bent portion 36*a* of the wire spring 36 is located in the first hole portion 38*a*, the bent portion 36*a* abuts against the rib 38*c* so that its motion is limited. Thus, the wire spring 36 can move vertically but cannot rotate. On the other hand, there is no rib on the inner side of the second hole portion 38*b*. Therefore, when the bent portion 36*a* is located in the second hole portion 38*b*, the wire spring 36 can rotate desirably without being limited as shown in FIG. 14, so that its free end side can be locked in the lock portion 37 to thereby press and urge the engagement pin 34. In such a manner, to press and urge the engagement pin 34, the upper end portion of the wire spring 36 has to be located in the second hole portion 38*b*. Thus, the direction and load of pressure applied to the recording head unit 15 by urging of the wire spring 36 is always constant.

Figure 15:
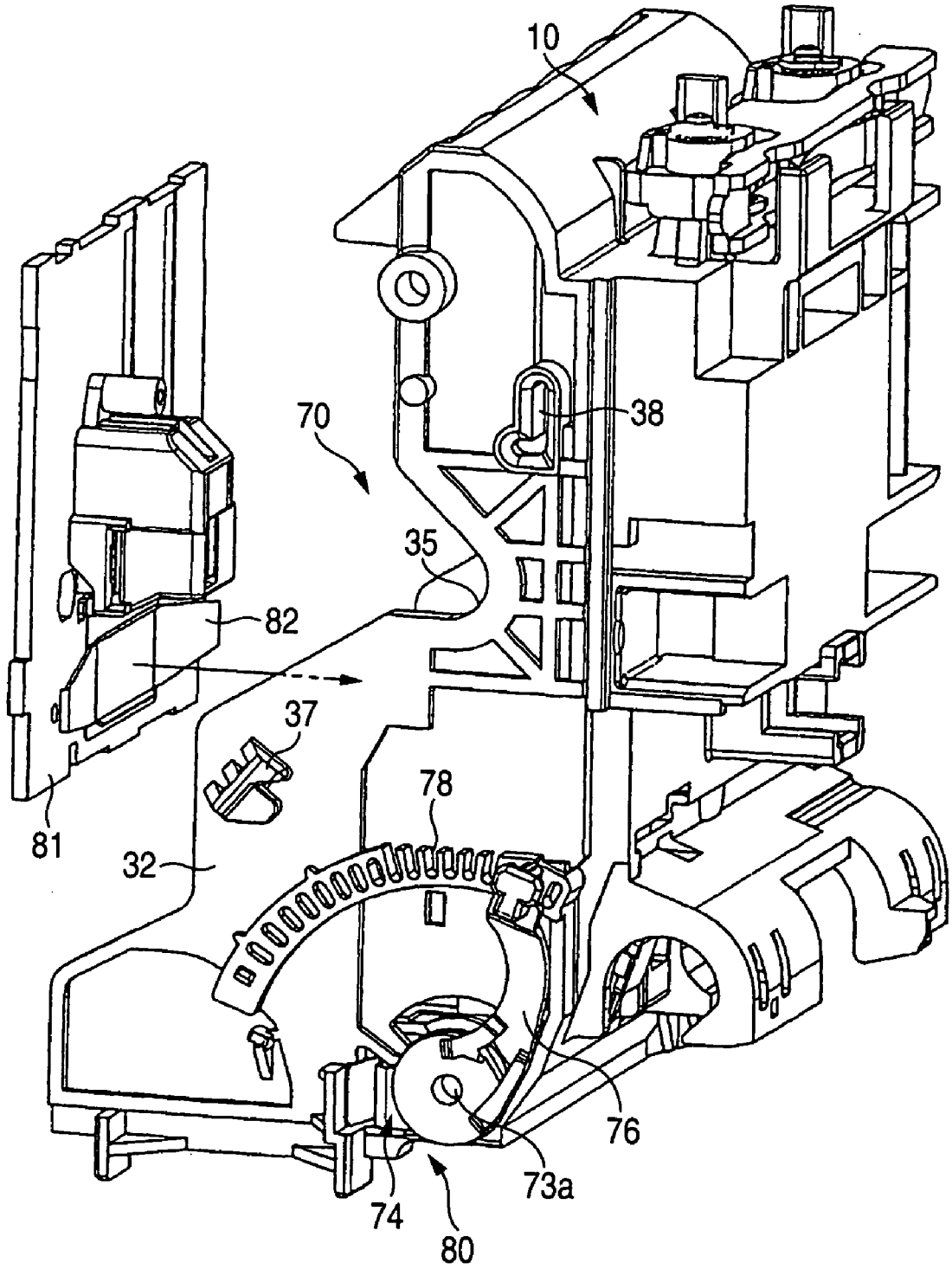
FIG. 15 is a perspective view showing the attachment position of the plate spring in a circuit board on the back of the recording head unit.

In addition, electric contact points (not shown) are formed in the back surface of the recording head unit 15. A circuit board 81 shown in FIG. 15 is disposed on the back surface side of the recording head unit 15 and put between the recording head unit 15 and the carriage 10 so as to be connected to the electric contact points. A plate spring 82 longer in width is attached to the back surface side of the circuit board 81 through a double-sided adhesive film of an insulator. As a result, when the recording head unit 15 is received in the head receiving portion 70, the circuit board 81 located on the back surface of the recording head unit 15 applies an urging force to the recording head unit 15. In the background art, a sponge is attached between the back surface of the recording head unit 15 and the carriage 10 so as to apply an urging force from the sponge. However, the sponge deteriorates largely with time and the urging force is instable. Thus, according to this embodiment, a plate spring is used to stabilize the electric connection between the recording head unit 15 and the circuit board 81.

Next, an inclination adjusting mechanism 80 provided in the carriage 10 will be described in detail. In the nozzle portions 15*a* of the recording head unit 15, as shown in FIG. 4, four nozzle arrays 15*a*' extending in the conveyance direction (arrow C) of a recording medium are formed correspondingly to the aforementioned four inks of cyan, yellow, magenta and black (incidentally, one nozzle array 15*a*' may be arrayed in staggered arrangement). While the nozzle portions 15*a* are fixedly attached to the recording head unit 15 with severe precision by use of a jig or the like at the time of manufacturing, the recording head unit 15 is removably attached to the carriage 10. Thus, when the recording head unit 15 is removed and attached, the nozzle arrays 15*a*' may be aligned incorrectly with respect to the carriage 10. In that event, as shown in FIG. 4, the nozzle arrays 15*a*' are not positioned in parallel with the conveyance direction (arrow C) of the recording medium, but have an inclination (angle θ). Thus, the printing quality is spoiled.

Therefore, in the inclination adjusting mechanism 80, after the recording head unit 15 is received in the head receiving portion 70 (whereupon the recording head unit 15 is positioned with respect to the carriage 10 to some extent), the recording head unit 15 is rotated slightly relatively to the carriage 10 so that the plane of the nozzle portions 15*a* of the recording head unit 15 rotates within the plane. In such a manner, the nozzle arrays 15*a*' are finely adjusted to be severely parallel with the conveyance direction (arrow C in FIG. 4) of the recording medium (to null the angle θ (see FIG. 4)).

Figure 7:
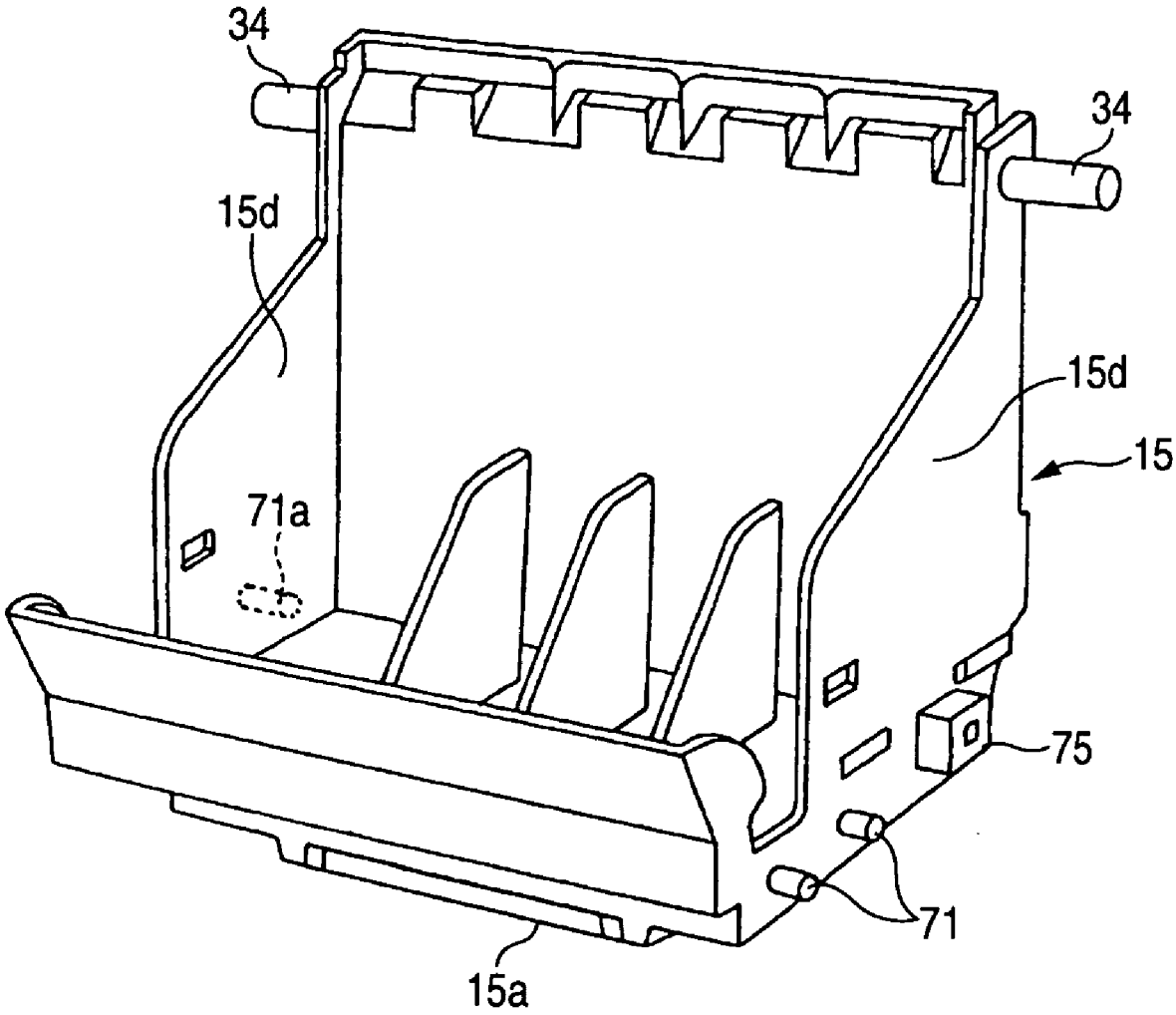
FIG. 7 is a front perspective view of the recording head unit excluding ink cartridges.
Figure 8:
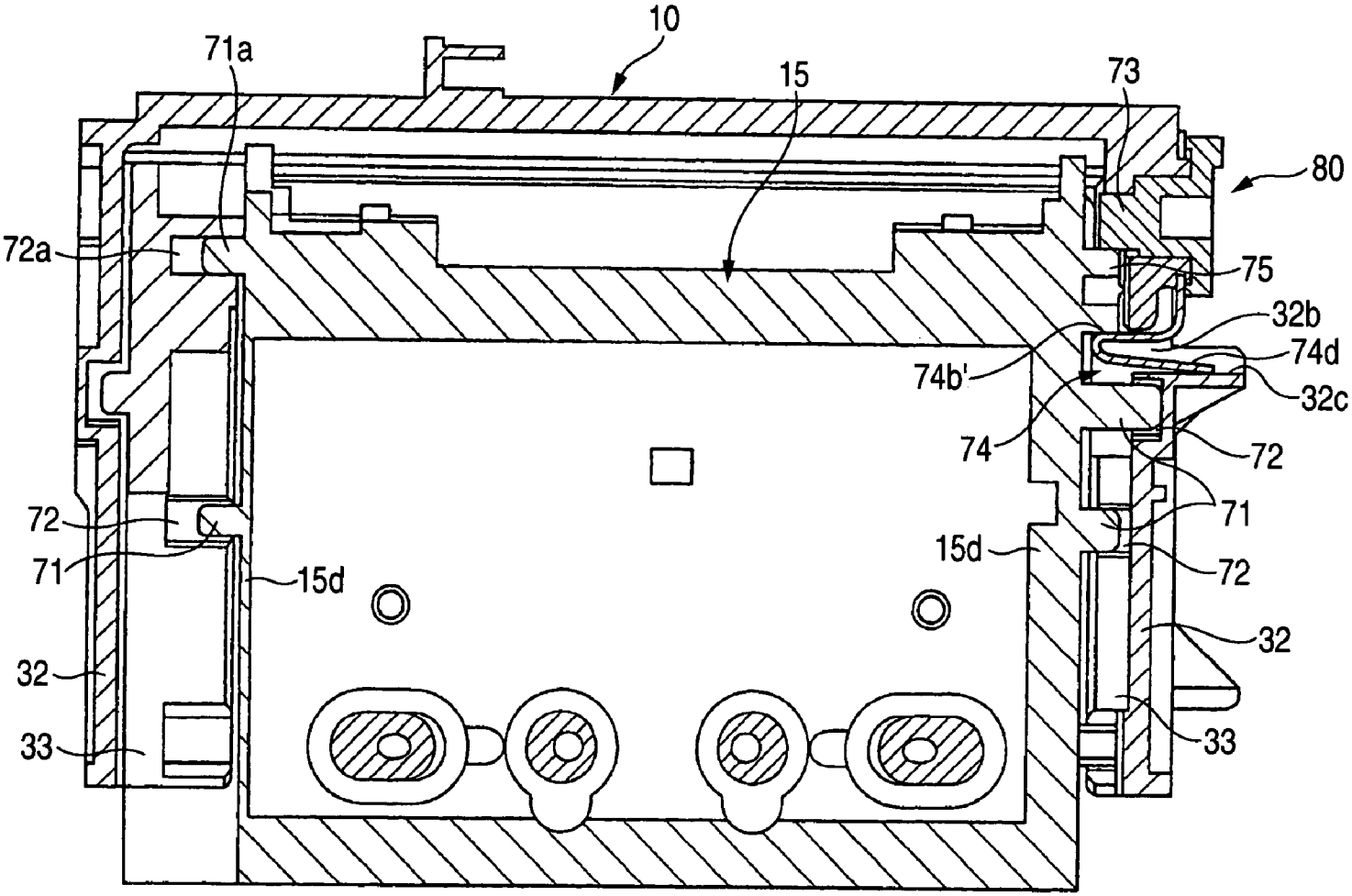
FIG. 8 is a cross-sectional view of the carriage mounted with the recording head unit.

The recording head unit 15 is received in the head receiving portion 70 while being supported by the left and right bottom support portions 33 of the carriage 10 as described previously. Specifically, as shown in FIG. 7, a plurality of columnar protrusion portions 71 are provided to project outward in the lower portions of left and right side surfaces 15*d* of the recording head unit 15, and the protrusion portions 71 are put down into reception portions 72 formed as depressions in the bottom support portions 33 of the carriage 10, respectively. As shown in FIG. 8, of the protrusion portions 71, a protrusion portion 71*a* (which functions as a first retained portion) provided on the back surface side of the left side plate 15*d* is fitted into a reception portion 72*a* (which functions as a first retention portion) provided in the left bottom support portion 33 of the carriage 10. The protrusion portion 71*a* and the reception portion 72*a* are fitted with a slight clearance required for rotating with the contact position between the protrusion portion 71*a* and the reception portion 72*a* being used as the pivoting point (center of rotation) of the recording head unit 15 by the inclination adjusting mechanism 80. The other protrusions 71 and the other reception portions 72 are fitted loosely enough not to hinder the recording head unit 15 from rotating.

On the other hand, the inclination adjusting mechanism 80 is provided in opposition to the pivoting point depending on the protrusion portion 71*a* and the reception portion 72*a*, that is, under the back surface side of the right side plate 32 of the carriage 10. This is because the inclination adjusting mechanism 80 is disposed at a distance from the pivoting point so that fine adjustment can be applied to the rotation of the recording head unit 15 easily.

Figure 10:
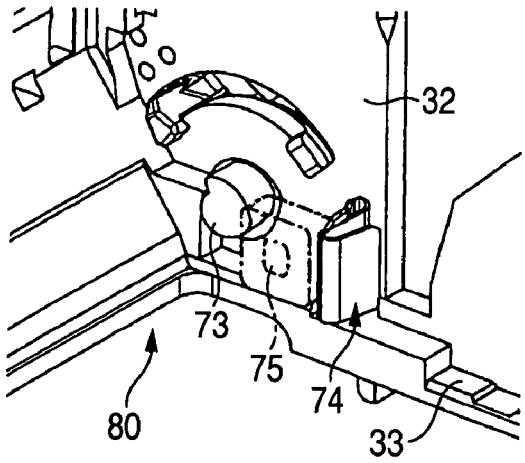
FIG. 10 is a perspective view of the inclination adjusting mechanism observed from its inside.

As the inclination adjusting mechanism 80, an eccentric rotor 73 and an urging member 74 are attached to the lower portion of the right side plate 32 of the carriage 10 close to its back surface in order from the back surface side so as to project inward (see FIGS. 8 and 10). The eccentric rotor 73 is a body of revolution whose outer circumferential surface is made eccentric on the inner side of the right side plate 32. The urging member 74 is formed out of a curved plate spring, which will be described later. In addition, as the inclination adjusting mechanism 80, an abutment portion 75 (which functions as a second retained portion) projecting outward is provided in the lower portion of the right side plate 15*d* of the left and right side plates 15*d* of the recording head unit 15 close to its back surface. Then, the recording head unit 15 is received in the head receiving portion 70 so that the abutment portion 75 is held between the eccentric rotor 73 and the urging member 74 and abuts against the eccentric rotor 73 and the urging member 74. Thus, the abutment portion 75 is always urged toward the eccentric rotor 73 by the urging member 74. In this embodiment, the abutment portion 75 has a substantially rectangular parallelepiped shape, and the back-surface-side surface of the abutment portion 75 abuts against the outer circumferential surface of the eccentric rotor 73 while the front-surface-side surface thereof abuts against the surface of the plate spring of the urging member 74.

The urging force applied to the abutment portion 75 by the urging member 74 so as to urge the abutment portion 75 toward the back surface is different from the urging force applied from the wire spring 36 to the abutment portion 75. The former is an urging force with which the abutment portion 75 is always pressed directly. Thus, not only when the abutment portion 75 is moved to the front surface side by the eccentric rotor 73 but also when it is moved to the back surface side, the abutment portion 75 always abuts against the outer circumference of the eccentric rotor 73. In other words, the abutment portion 75 is designed to move constantly following the motion of the eccentric rotor 73.

The eccentric rotor 73 is inserted into a mounting hole 32*a* from the outside to the inside. The mounting hole 32*a* is provided in the right side plate 32 of the carriage 10 so as to have a circular opening. A lever portion 76 interlocking with the eccentric rotor 73 is attached to a base portion 73*a* of the eccentric rotor 73 on the outer side of the right side plate 32. Then, a releasable engagement pin 77 is provided in the forward end portion of the lever portion 76, while a plurality of adjusting reception portions 78 capable of engaging with the engagement pin 77 are provided on the outer side of the right side plate 32 so as to describe a circular arc. Thus, in accordance with the position of the adjusting reception portion 78 the engagement pin 77 is engaged with, the rotation angle of the eccentric rotor 73 is changed so that the front/back moving distance of the abutment portion 75 the eccentric rotor 73 abuts against can be changed. In such a manner, the rotation of the eccentric rotor 73 is adjusted by the large circular arc using a stroke of the lever portion 76 so that the rotating distance of the eccentric rotor 73, the moving distance of the abutment portion 75 and hence the inclination angle θ of the nozzle arrays 15*a*' can be finely adjusted easily. Incidentally, in a specific embodiment, 17 adjusting reception portions 78 are arrayed in a circular arc portion at an angle of about 90 degrees so that the inclination of the nozzle arrays 15*a*' can be finely adjusted in ±8 steps with respect to a reference phase.

Figure 9:
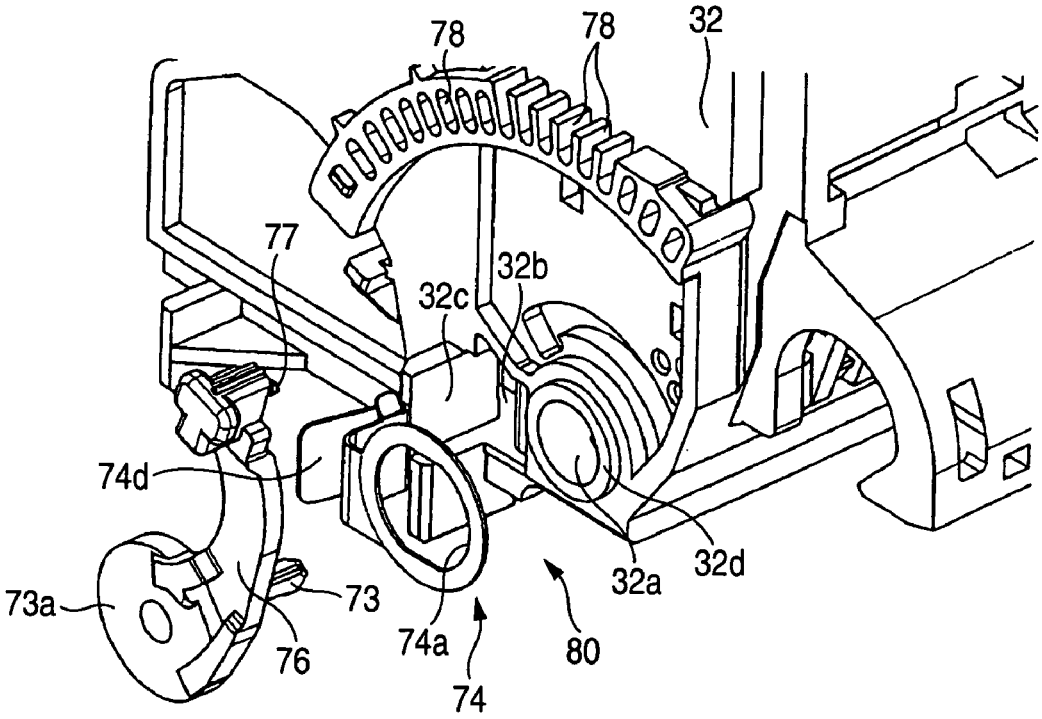
FIG. 9 is a partially exploded perspective view of an inclination adjusting mechanism.
Figure 11A:
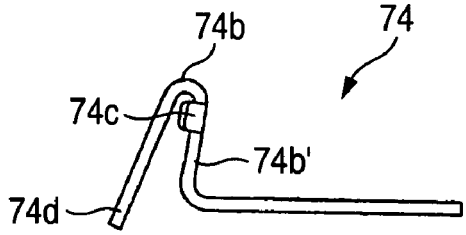
FIG. 11A is a plan view of an urging member.
Figure 11B:
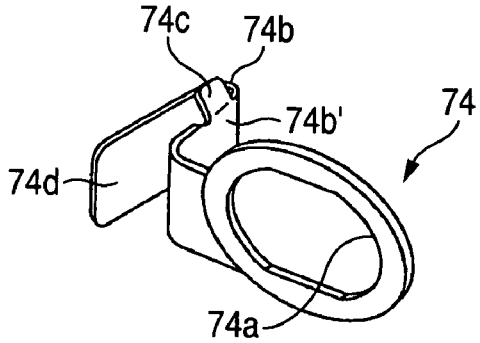
FIG. 11B is a perspective view of the urging member.
Figure 11C:
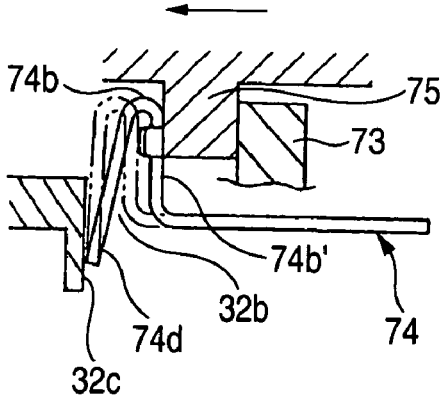
FIG. 11C is an explanatory view showing the operation of the urging member.

The urging member 74 is formed, as shown in FIG. 11A, by bending a plate spring into a U-lettered shape on its forward end side as a bent portion 74*b*, which is inserted into a mounting hole 32*b* from the outside to the inside. The mounting hole 32*b* is provided in the right side plate 32 of the carriage 10 so as to have a substantially rectangular opening. Then, as shown in FIGS. 9 and 11C, a forward end portion 74*d* of the plate spring abuts against a support piece portion 32*c* projecting outward continuously from the front-surface-side inner wall surface where the mounting hole 32*b* is formed. Thus, the bent portion 74*b* can apply an elastic force to the abutment portion 75 so as to press and urge the abutment portion 75. In addition, a projecting piece 74*c* is provided to project from the upper portion of the bent portion 74*b* so as to guide the abutment portion 75 of the head unit when the abutment portion 75 is set.

An abutment surface 74*b*' where the bent portion 74*b* abuts against the abutment portion 75 is formed substantially in parallel with the opposed surface of the abutment portion 75. Thus, as shown by the solid line in FIG. 11C, the abutment portion 75 abuts against the abutment surface 74*b*' of the bent portion 74*b* in surface contact therewith so that the abutment portion 75 can be prevented from being pressed and urged unstably due to abutment at its one end.

The base end portion of the plate spring of the urging member 74 is attached to the outer side of the side plate 32 of the carriage 10. A mounting hole 74*a* formed in the base end portion is formed into a long hole which is longer in the moving direction of the abutment portion 75 as shown in FIG. 11B, and loose-fitted to the shaft of the eccentric rotor 73. Specifically, as shown in FIG. 9, the mounting hole 74*a* of the plate spring is fitted to the outer circumference of a ring-like edge portion 32*d* formed at the edge of the mounting hole 32*a* of the eccentric rotor 73 coaxially with the shaft of the eccentric rotor 73. The mounting hole 74*a* is pressed by the base portion 73*a* of the eccentric rotor 73 so as not to fall off. With such a configuration, in accordance with the bent portion 74*b* pressed forward due to the forward movement of the abutment portion 75 as shown by the chain line in FIG. 11C, the urging member 74 moves slightly in the moving direction. That is even when the abutment portion 75 moves the urging member 74 presses the abutment portion 75 while keeping the surface contact between the abutment portion 75 and the abutment surface 74*b*' of the bent portion 74*b*. Thus, the abutment portion 75 is further prevented from abutting at its one end, so that the condition that the abutment portion 75 is pressed and urged can be stabilized.

Incidentally, the invention is applied not only to the aforementioned embodiment in which nozzle arrays are disposed in the conveyance direction C of the recording medium, which is the sheet P. The inclination adjusting mechanism may be applied to a mode in which nozzle arrays extend in a direction crossing the conveyance direction C of the recording medium. For example, such a mode includes the case where a recording head unit having nozzle arrays each having a length required for securing the printable width of the recording medium is mounted on a fixed (non-moving) carriage.

In accordance with various instructions inputted from the operator through various key operations in the operation panel portion 6, the multifunctional apparatus 1 described above has not only a normal facsimile function of setting various processing operations, scanning a sheet image using the sheet scanning unit 5, converting the sheet image into data to be transmitted, encoding the data to be transmitted, transmitting or receiving facsimile data transmitted to or from another facsimile machine through a communication line such as a phone line, decoding received data, and recording the decoded facsimile data onto sheet P in the recording unit, but also a copying machine processing function of scanning a sheet using a CIS (Contact Image Sensor) of the sheet scanning unit 5 and forming a color image onto the sheet P by means of respective units of the recording portion, a printer processing function of forming a color image on the sheet P in accordance with print data transmitted from not-shown external apparatus such as a personal computer (host computer) through a printer cable or by wireless using infrared light or the like, and a scanner processing function of transmitting the image data read by the sheet scanning unit 5 to the external apparatus.

Incidentally, in this embodiment, the apparatus for forming an image on paper has the aforementioned mechanism concerning the formation of a gap between the face surface of the recording head unit 15 and the sheet P and the adjustment of the size of the gap having influence on the printing quality. Accordingly, the mechanism will be described with reference to FIGS. 2A, 2B and 3 through 5.

The frame 12 has a longitudinal plate portion 12*a*, a horizontal support portion 12*b* and a rail portion 12*c* as shown in FIG. 5. The longitudinal plate portion 12*a* is provided erectly substantially in parallel with the back plate 31 of the carriage 10. The horizontal support portion 12*b* is formed by bending the upper end of the longitudinal plate portion 12*a* rearward (in opposition to the portion where the carriage 10 is disposed). The rail portion 12*c* is put on the top of the horizontal support portion 12*b* and fixedly attached thereto by a screw 13. The rail portion 12*c* is formed into an L-lettered shape in section, having a horizontal portion 12*d* extending forward and a vertical rail portion 12*e* formed by bending the front end of the horizontal portion 12*d* downward. The vertical rail portion 12*e* in the rail portion 12*c* faces the rear end portion of the top of the carriage 10. The position where the horizontal portion 12*d* is attached to the horizontal support portion 12*b* of the frame 12 is adjusted so that the distance between the longitudinal plate portion 12*a* and the vertical rail portion 12*e* can be finely adjusted. Thus, the size of a gap. (G1, see FIG. 5) between the nozzle surface of the recording head unit 15 and the platen 25 can be adjusted in advance in the state where a first abutment portion 50 and a second abutment portion 51 which will be described later abut against a sliding surface 12*e*' which is an inner surface of the vertical rail portion 12*e*.

The left plate of the frame 12 is bent forward to form a left piece 12*f* having a function of a first pressing member, while the horizontal portion 12*d* of the frame 12 is cut to rise downward above the maintenance portion 27 so as to form a tongue piece 12*h* having a function of a second pressing member (see FIG. 2B).

As shown in FIG. 3, a first abutment portion 50 made of synthetic resin and having a block-like shape is fixedly attached to the substantially central portion of the rear end portion of the top of the carriage 10 so as to abut slidably on the sliding surface 12*e*' on the inner surface side of the vertical rail portion 12*e* of the frame 12. Further, in the rear end portion of the top of the carriage 10, a pair of pivots 54 are provided erectly upward on the opposite sides of the first abutment portion 50 so as to put the first abutment portion 50 therebetween. A pair of guide pieces 41 are rotatably fitted to the pivots 54 respectively. Each guide piece 41 is linked through a support portion (not shown) to a changeover link piece 40 longer in the moving direction of the carriage 10, so that the guide piece 41 can rotate horizontally with respect to the changeover link piece 40. That is, a pair of guide pieces 41 linked rotatably horizontally at their support portions (not shown) to one changeover link piece 40 are supported so that the guide pieces 41 can rotate horizontally with respect to the pair of pivots 54 respectively. Thus, a parallel link mechanism is constructed.

The pair of left and right guide pieces 41 are formed to have one and the same shape in plan view. A second abutment portion 51 abutting and sliding on the sliding surface 12*e*' on the inner surface side of the vertical rail portion 12*e* is provided in each guide piece 41. Further, a second protrusion portion 59 is formed upward on the top side of the changeover link piece 40 (see FIG. 3).

In addition, a pair of spring seats 60 each having an L-lettered shape in plan view are provided erectly in the rear end portion (back surface side) of the top of the carriage 10. Free end portions on the opposite, left and right sides of an arched plate spring 61 inserted into a recess portion in the back surface of the changeover link piece 40 are supported by the pair of spring seats 60. The changeover link piece 40 is pushed forward away from the carriage 10 due to an urging force of the plate spring 61.

Description will be made on the multifunctional apparatus 1 having such a changeover mechanism 30 for adjusting a gap, as to its operation and action for adjusting the size of the gap (G1) between the recording head unit 15 and the top (surface which is the path the sheet P as a recording medium passes through) of the platen 25. For example, when the printer processing function is executed, printer driver software installed in external apparatus such as a personal computer is activated. Then, the kind of a recording medium (sheet P) to be printed (recorded) on is selected. In this event, the gap can be set to be small when plain paper (for example, letter paper or A4 paper) is selected, and the gap can be set to be large when an envelope is selected.

First, description will be made on the case where printing is performed on plain paper. In response to a printing command, the carriage 10 located in the home position. (cap position) 28 moves in the arrow A direction, and the left side plate 12*f* substantially at the dead end portion of the movement of the carriage 10 serves as a first pressing member so as to push the first protrusion portion 42 of the changeover link piece 40 from left to right in FIG. 2B as shown on the left side of FIG. 2B. As a result, the changeover link piece 40 moves to the right direction (arrow B direction) so that the pair of guide pieces 41 rotate in the arrow B direction. Thus, the second abutment portions 51 are retracted that the first abutment portion 50 fixed to the top of the carriage 10 abuts against the sliding surface 12*e*' of the frame 12. The carriage 10 rotates downward around the round-shaft-like guide shaft 11 due to its own weight. Thus, the face surface corresponding to the lower surfaces of the nozzle portions 15*a* approaches the top of the platen 25 so that the gap G1 is changed to be small, and the posture is kept.

Next, the carriage 10 is moved in the arrow B direction so that characters and the like can be printed on the plain paper within the recordable (printable) range.

When printing is performed on an envelope thicker than the plain paper, the envelope moving in the paper conveyance path touches the nozzle portions 15*a* to stain its surface with ink unless the gap is increased. Therefore, for example, on the assumption that printing was performed on plain paper in the last printing operation, when the carriage 10 is moved in the arrow B direction so as to be retracted to the home position (cap position) 28 after the termination of the printing, the second protrusion portion 59 of the right guide piece 41 abuts against the tongue piece plate 12*h* serving as a second pressing member so as to be pushed to the left as shown in the right side of FIG. 2B.

Thus, the postures of the changeover link piece 40 and the left guide piece 41 together with the posture of the right guide piece 41 are changed so that the second abutment portions 51 in the pair of guide pieces 41 project to abut against the sliding surface 12*e*' of the frame 12. Then, the carriage 10 rotates upward around the guide shaft 11 so that the face surface corresponding to the lower surfaces of the nozzle portions 15*a* of the recording head unit 15 leaves the top of the platen 25. Thus, the gap G1 is changed to be large (enough to print on an envelope), and the posture is kept. As a result, the surface of the envelop does not touch the nozzle portions 15*a* at the time of printing, so that the envelop can be prevented from being stained with unnecessary ink adhering thereto.

In the multifunctional apparatus 1 described in the above, the recording head unit 15 is retained by a carriage 10 to be moved in the direction orthogonal to the conveyance direction of the sheet P. However, the multifunctional apparatus 1 may be configured as a so-called line head-type printer in which the recording head unit 15 is directly fixed to a frame of the apparatus and forms an image on the sheet P without moving in the orthogonal direction.

In a case where configuring the multifunctional apparatus 1 as the line head-type printer, the each of the nozzle arrays is provided to extend in the direction orthogonal to the conveyance direction of the sheet P for at least a same length as that of a width of the sheet P, and the recording head unit 15 is fixed to a retaining member such as a frame of the multifunctional apparatus 1.

In the multifunctional apparatus 1 thus configured, there is no need to move the recording head unit 15 with a carriage 10 when forming an image on the sheet P. Therefore, the thus configured multifunctional apparatus 1 can improve the quality of the formed image. Moreover, there is no need to provide a mechanism, such as the carriage 10, to move the recording head unit 15 in the direction orthogonal to the conveyance direction of the sheet P. Therefore, the thus configured image forming apparatus 1 can reduce the overall product cost of the image forming apparatus 1 itself.

The multifunctional apparatus 1, which is described in the above, is configured to be usable as a serial-type image scanner by replacing the recording head unit 15 with a scanning head including at least one scanning device that scans the image formed on the sheet P and outputs an electronic signal.

When using the multifunctional apparatus 1 as an image scanner, the recording head unit 15 is removed from the carriage 10 and the scanning head is mounted onto the carriage 10. Thereafter, the sheet P is conveyed while moving the carriage 10 in a direction orthogonal to the conveyance direction of the sheet P, and the image formed on the sheet P is scanned by the scanning head.

Incidentally, the multifunctional apparatus 1 may be configured so that the recording head unit 15 is non-replaceable with the scanning head, or be configured so that only the scanning head is to be mounted on the carriage 10 and made non-replaceable with the recording head unit 15.

Incidentally, not to say, the invention is applicable not only to the aforementioned multifunctional apparatus but also to printers, copying machines, and carriage-mounting type image scanners.

According to a first aspect of the invention, there is provided an image forming apparatus including: a recording head unit having a first retained portion and one or more nozzle arrays in a nozzle surface thereof, each of the nozzle arrays being formed of a plurality of nozzles for ejecting ink onto a recording medium; and a retaining member that retains the recording head unit and includes: a first retention portion that retains the first retained portion of the recording head unit to allow the nozzle surface rotate within a plane thereof by using the first retained portion as a center of rotation; an inclination adjusting mechanism that moves the recording head unit with respect to the retaining member with the first retained portion being used as the center of rotation; and an urging member that presses and urges the recording head unit against the inclination adjusting mechanism and moves in cooperation with the inclination adjusting mechanism.

According to the first aspect of the invention, when the nozzle arrays of the recording head unit are not attached in an appropriate direction, the recording head unit is rotated by the inclination adjusting mechanism so that the inclination of the array direction of the nozzle arrays is adjusted. Since the recording head unit is urged by the urging member, the recording head unit follows the adjustment of the inclination quickly so that accurate adjustment can be performed.

The image forming apparatus according to the first aspect of the invention may be configured so that each of the nozzle arrays is provided to extend in a conveyance direction of the recording medium.

The image forming apparatus according to the first aspect of the invention may be configured so that each of the nozzle arrays is provided to extend in a direction orthogonal to a conveyance direction of the recording medium.

The image forming apparatus according to the first aspect of the invention may be configured so that the retaining member comprises a carriage on which the recording head unit is mounted and moves the recording head unit in a direction orthogonal to a conveyance direction of the recording medium.

In the first aspect of the invention, the image forming apparatus may be configured so that the retaining member further includes a head receiving portion that supports the recording head unit rotatably within the plane of the nozzle surface, and wherein the inclination adjusting mechanism is disposed in the head receiving portion at a position where opposes to the first retention portion. With this configuration, since the inclination adjusting mechanism for moving the recording head unit is provided to be opposed to the first retention portion serving as the center of rotation and at a distance from the first retention portion, adjustment with a small angle of rotation can be achieved by a large distance of movement. Thus, accurate adjustment can be attained.

In the above configuration, the image forming apparatus may further be configured so that the inclination adjusting mechanism includes an eccentric rotor, wherein the recording head unit includes a second retained portion disposed at a position where opposes to the first retained portion, wherein the eccentric rotor and the urging member are provided in the head receiving portion so as to inward on at least one of left and right side surfaces of the head receiving portion, and wherein the second retained portion is retained to be sandwiched between the eccentric rotor and the urging member. With this configuration, the second retained portion abutting against the eccentric rotor due to its rotation moves forward/backward. However, the second retained portion is always pressed and urged toward the eccentric rotor by the urging member. Accordingly, even when the second retained portion moves either forward or backward, the abutment portion can abut against the eccentric rotor so as to follow the motion of the eccentric rotor surely.

In the above configuration, the image forming apparatus may further be configured so that the urging member includes a plate spring, whereupon a mounting hole longer in a moving direction of the second retained portion is formed in a base end portion of the plate spring, the plate spring including a forward end portion that is bent and inserted into the head receiving portion from outside of the side surface thereof so as to abut against the second retained portion, and wherein the urging member is attached to the outside of the side surface of the head receiving portion through the mounting hole so as to be slightly movable in accordance with movement of the second retained portion caused by the eccentric rotor, and in the same direction as the movement. With this configuration, since the urging member is formed by bending a plate spring, the urging force changes in accordance with the position and state where the second retained portion abuts against the plate spring. However, the second retained portion moves in accordance with the movement of the urging member. Accordingly, the urging member can apply the pressing/urging force to the second retained portion while keeping the initial posture of the urging member abutting against the second retained portion.

In the above configuration, the image forming apparatus may further be configured so that the mounting hole is loose-fitted to a shaft of the eccentric rotor on the outer side of the side surface of the head receiving portion. With this configuration, since the base end portion of the urging member comprised of the plate spring is attached to the shaft of the eccentric rotor, the urging member and the eccentric rotor always apply a force to each other without separating from each other.

In the above configuration, the image forming apparatus may further be configured so that the second retained portion is formed into a substantially rectangular parallelepiped shape, and wherein of the forward end portion of the plate spring, a portion abutting against the second retained portion is formed substantially in parallel with an end surface of the second retained portion. With this configuration, since an end surface of the second retained portion has a surface contact with the plate spring, the urging force applied to the second retained portion by the urging member is stabilized.

According to a second aspect of the invention, there is provided an image scanner including: a scanning head unit having a first retained portion and a scanning surface that scans an image formed on a medium to be scanned; and a retaining member that retains the scanning head unit and includes: a first retention portion that retains the first retained portion of the scanning head unit to allow the scanning surface rotate within a plane thereof by using the first retained portion as a center of rotation; an inclination adjusting mechanism that moves the scanning head unit with respect to the retaining member with the first retained portion being used as the center of rotation; and an urging member that presses and urges the scanning head unit against the inclination adjusting mechanism and moves in cooperation with the inclination adjusting mechanism.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus comprising:

a recording head unit having a first retained portion and one or more nozzle arrays in a nozzle surface thereof, each of the nozzle arrays being formed of a plurality of nozzles for ejecting ink onto a recording medium;

a retaining member that retains the recording head unit;

a first retention portion that retains the first retained portion of the recording head unit to allow the nozzle surface rotate within a plane thereof by using the first retained portion as a center of rotation;

an inclination adjusting mechanism that moves the recording head unit with respect to the retaining member with the first retained portion being used as the center of rotation; and an urging member that presses and urges the recording head unit against the inclination adjusting mechanism and moves in cooperation with the inclination adjusting mechanism;

wherein the urging member is provided at a recording head unit mounting hole, the urging member urging an inner peripheral surface in the recording head unit mounting hole toward the inclination adjusting mechanism.

2. The image forming apparatus according to claim 1, wherein each of the nozzle arrays is provided to extend in a conveyance direction of the recording medium.

3. The image forming apparatus according to claim 1, wherein each of the nozzle arrays is provided to extend in a direction orthogonal to a conveyance direction of the recording medium.

4. The image forming apparatus according to claim 3, wherein the each of the nozzle arrays is provided to extend in the direction orthogonal to the conveyance direction of the recording medium for at least a same length as that of a width of the recording medium, and wherein the recording head unit is fixed to the retaining member.

5. The image forming apparatus according to claim 1, wherein the retaining member comprises the first retention portion, the inclination adjusting mechanism and the urging member.

6. The image recording apparatus according to claim 1, wherein the retaining member comprises a carnage on which the recording head unit is mounted and moves the recording head unit in a direction orthogonal to a conveyance direction of the recording medium.

7. The image forming apparatus according to claim 1, wherein the retaining member further comprises a head receiving portion that supports the recording head unit rotatably within the plane of the nozzle surface, and wherein the inclination adjusting mechanism is disposed in the head receiving portion at a position opposed to the first retention portion.

8. The image forming apparatus according to claim 7, wherein the inclination adjusting mechanism comprises an eccentric rotor, wherein the recording head unit comprises a second retained portion disposed at a position opposed to the first retained portion, wherein the eccentric rotor and the urging member are provided in the head receiving portion so as to inward on at least one of left and right side surfaces of the head receiving portion, and wherein the second retained portion is retained to be sandwiched between the eccentric rotor and the urging member.

9. The image forming apparatus according to claim 8, wherein the urging member comprises a plate spring, whereupon a plate spring mounting hole longer in a moving direction of the second retained portion is formed in a base end portion of the plate spring, the plate spring including a forward end portion that is bent and inserted into the head receiving portion from outside of the side surface thereof so as to abut against the second retained portion, and wherein the urging member is attached to the outside of the side surface of the head receiving portion through the plate spring mounting hole so as to be slightly movable in accordance with movement of the second retained portion caused by the eccentric rotor, and in the same direction as the movement.

10. The image forming apparatus according to claim 9, wherein the plate spring mounting hole is loose-fitted to a shaft of the eccentric rotor on the outer side of the side surface of the head receiving portion.

11. The image forming apparatus according to claim 9, wherein the second retained portion is formed into a substantially rectangular parallelepiped shape, and wherein of the forward end portion of the plate spring, a portion abutting against the second retained portion is formed substantially in parallel with an end surface of the second retained portion.

12. The image forming apparatus according to claim 1, wherein the first retention portion projects from a surface perpendicular to the nozzle surface.

13. An image scanner comprising:

a scanning head unit having a first retained portion and a scanning surface that scans an image formed on a medium to be scanned;

a retaining member that retains the scanning head unit;

a first retention portion that retains the first retained portion of the scanning head unit to allow the scanning surface rotate within a plane thereof by using the first retained portion as a center of rotation;

an inclination adjusting mechanism that moves the scanning head unit with respect to the retaining member with the first retained portion being used as the center of rotation; and an urging member that presses and urges the scanning head unit against the inclination adjusting mechanism and moves in cooperation with the inclination adjusting mechanism;

wherein the urging member is provided at a scanning head unit mounting hole, the urging member urges an inner peripheral surface in the scanning head unit mounting hole toward the inclination adjusting mechanism.

14. The image scanner according to claim 13, wherein the retaining member comprises the first retention portion, the inclination adjusting mechanism and the urging member.

15. The image scanner according to claim 13, wherein the retaining member comprises a carriage on which the scanning head unit is mounted and moves the scanning head unit in a direction orthogonal to a conveyance direction of the medium.

16. The image scanner according to claim 13, wherein the retaining member further comprises a head receiving portion that supports the scanning head unit rotatably within the plane of the nozzle surface, and wherein the inclination adjusting mechanism is disposed in the head receiving portion at a position opposed to the first retention portion.

17. The image scanner according to claim 16, wherein the inclination adjusting mechanism comprises an eccentric rotor, wherein the scanning head unit comprises a second retained portion disposed at a position opposed to the first retained portion, wherein the eccentric rotor and the urging member are provided in the head receiving portion so as to inward on at least one of left and right side surfaces of the head receiving portion, and wherein the second retained portion is retained to be sandwiched between the eccentric rotor and the urging member.

18. The image forming apparatus according to claim 17, wherein the urging member comprises a plate spring, whereupon a plate spring mounting hole longer in a moving direction of the second retained portion is formed in a base end portion of the plate spring, the plate spring including a forward end portion that is bent and inserted into the head receiving portion from outside of the side surface thereof so as to abut against the second retained portion, and wherein the urging member is attached to the outside of the side surface of the head receiving portion through the plate spring mounting hole so as to be slightly movable in accordance with movement of the second retained portion caused by the eccentric rotor, and in the same direction as the movement.

19. The image scanner according to claim 18, wherein the plate spring mounting hole is loose-fitted to a shaft of the eccentric rotor on the outer side of the side surface of the head receiving portion.

20. The image scanner according to claim 19, wherein the second retained portion is formed into a substantially rectangular parallelepiped shape, and wherein of the forward end portion of the plate spring, a portion abutting against the second retained portion is formed substantially in parallel with an end surface of the second retained portion.

21. The image scarmer according to claim 13, wherein the first retention portion projects from a surface perpendicular to the nozzle surface.

* * * * *